US010633932B1

(12) United States Patent
Mazzanti

(10) Patent No.: US 10,633,932 B1
(45) Date of Patent: Apr. 28, 2020

(54) SYSTEM AND METHOD TO REDUCE WELLBORE ANNULAR FLUID VOLUMES

(71) Applicant: Daryl Vincent Mazzanti, Montgomery, TX (US)

(72) Inventor: Daryl Vincent Mazzanti, Montgomery, TX (US)

( * ) Notice: Subject to any disclaimer, the term of this patent is extended or adjusted under 35 U.S.C. 154(b) by 177 days.

(21) Appl. No.: 15/836,823

(22) Filed: Dec. 9, 2017

Related U.S. Application Data

(60) Provisional application No. 62/435,745, filed on Dec. 17, 2016.

(51) Int. Cl.
*E21B 17/00* (2006.01)
*E21B 19/00* (2006.01)
*E21B 43/12* (2006.01)

(52) U.S. Cl.
CPC ..... *E21B 17/006* (2013.01); *E21B 19/00* (2013.01); *E21B 43/122* (2013.01)

(58) Field of Classification Search
CPC ..... E21B 17/006; E21B 19/00; E21B 43/122; E21B 43/121
See application file for complete search history.

(56) References Cited

U.S. PATENT DOCUMENTS 1,201,706 A * 10/1916 Dodge ..... F16B 2/065 403/344
3,012,585 A 12/1961 Obrien et al.
3,063,760 A * 11/1962 Gifford ..... E21B 17/1042 175/325.5
3,184,358 A * 5/1965 Utz ..... B29C 66/492 156/244.14
3,360,846 A * 1/1968 Schellstede ..... E21B 17/12 29/447
3,382,930 A 5/1968 Ribb et al.
3,415,287 A 12/1968 Heslop et al.
4,028,796 A 6/1977 Bergstrom
4,141,386 A 2/1979 Bergstrom
4,211,440 A 7/1980 Bergstrom
4,349,050 A 9/1982 Bergstrom
4,685,518 A 8/1987 Claycomb
4,889,185 A * 12/1989 Uherek, Sr. et al. ..... E21B 17/1085 166/243
5,016,921 A 5/1991 Claycomb
5,549,333 A 8/1996 Uherek et al.
6,619,392 B2 9/2003 Marangoni et al.
8,286,715 B2 10/2012 Bailey et al.
8,602,113 B2 12/2013 Jin et al.
2007/0158061 A1* 7/2007 Casey ..... E21B 43/121 166/68

(Continued)

*Primary Examiner* — Michael R Wills, III

(57) ABSTRACT

A system and method for reducing the annular fluid volume in a wellbore to increase the lift efficiency of a lift system. In the preferred embodiment, a plunger lift system is installed in combination with a production tubing containing one or more joints with an increased outer diameter created by surrounding the joints by a material comprised of a differing composition than the composition of the joints. The increased outer diameter joints are placed in the liquid filled portion of the casing annulus above the setting depth of the plunger to reduce the accommodation space to liquids, resulting in a reduced annular liquid volume and an increase in the lift efficiency of the plunger lift system.

11 Claims, 3 Drawing Sheets

(56) References Cited

U.S. PATENT DOCUMENTS

2007/0181311 A1* 8/2007 Bender ..... E21B 43/121
166/369
2015/0047907 A1* 2/2015 Buytaert ..... E21B 17/1028
175/57

* cited by examiner

SYSTEM AND METHOD TO REDUCE WELLBORE ANNULAR FLUID VOLUMES

1. FIELD OF THE DISCLOSURE

The present disclosure generally relates to a system and method to reduce the annular fluid volume in a wellbore to increase the lift efficiency of a lift system in a wellbore

2. DESCRIPTION OF THE RELATED ART

The annular volume in a wellbore is herein defined as the accommodation space to fluids between the casing and the production tubulars. It is an object of this disclosure to reduce the annular fluid volume in the wellbore. Another object of this disclosure is to increase the lift efficiency of a lift system, particularly a plunger lift system, by reducing the volume of the annular fluids. Plunger lift is a well-known lift method with one of the lowest operating and equipment cost in the oil and gas industry. It utilizes a free-floating piston that travels up and down the production tubing with only the energy supplied by the reservoir. The process begins by shutting the well off from flow to allow the reservoir to increase the wellbore pressure. Gas and liquids flow into the wellbore and separate to create a gas column on top of a liquid column in the casing annulus and the production tubing. The plunger functions to minimize liquid fall back which normally occurs during flow due to gravity and the frictional contact of the liquid with the inner walls of the tubing. Once a sufficient pressure is obtained at the surface, the production tubing is opened for flow which provides a pressure differential that allows the annular gas to displace the annular liquids into the production tubing, which subsequently raises the plunger off bottom. Once the annular liquids are transferred into the production tubing, the annular gas can then flow into the production tubing and rises through the liquid column to contact the plunger. The plunger, and liquids above it, are lifted to the surface when a sufficient volume of gas accumulates under the plunger. At the surface, the plunger is normally temporarily detained by a catcher assembly while the gas and liquids flow into the surface facilities. After a time, the well is shut in and the plunger is released and falls to the bottom of the production tubing, so the process may begin again.

It is important to understand certain plunger lift realities. As stated previously, the liquid volume under the plunger in the production tubing increases due to the transfer of liquids from the casing annulus during the lift cycle. The volume of the transferred liquids and the cross-sectional area of the production tubing determine the liquid level in the production tubing under the plunger. In contrast, prior to the plunger lift cycle, the liquid level in the casing annulus is not determined by its cross-sectional area, but mainly by factors such as the reservoir pressure, surface pressure, and liquid density. In general, a higher annular liquid level is obtained when there is a low liquid density, low surface pressure, and a high reservoir pressure, and conversely, a lower annular liquid level is obtained for a high liquid density, high surface pressure and a low reservoir pressure. It is also important to understand that for comparable liquid volumes, a much higher liquid level is realized in the production tubing versus the previous liquid level that existed in the casing annulus prior to the beginning of the lift cycle. The reason is the casing annular cross-sectional area is much larger than the internal cross-sectional area of the production tubing. Since hydrostatic pressure is determined by the liquid column height and not necessarily the liquid volume, the resulting hydrostatic pressure at the bottom of the production tubing is much greater than the previous hydrostatic pressure in the casing annulus at similar depths. Once annular liquids are transferred to the production tubing, the increase in hydrostatic pressure at the bottom of the production tubing results in a reduced pressure differential that may cause a lower average plunger rise velocity and plunger stalls. Plunger stalls and lower plunger rise velocities allow higher liquid leakage past the plunger and a lower plunger lift efficiency.

Additionally, under-plunger liquids, such as the casing annular liquids and liquids that leak past the plunger, do not normally reach the surface due to the forces causing liquid fall back. It also is important to understand that when a significant liquid column exists in the production tubing, the gas will rise in the production tubing in a slug pattern of flow. As these slugs of gas move up the liquid column, liquid slugs will begin to fall down the production tubing, restricting the rise velocity of subsequent gas slugs. Furthermore, the plunger velocity may not substantially increase to prevent high liquid leakage rates until a significant volume of gas accumulates under the plunger. In other words, annular liquids act as a spacer that delays or may even prevent the annular gas from reaching the plunger. Lastly, for plunger lift operation and efficiency, it is important that the production tubing string has a consistent internal diameter to facilitate the passage of the plunger and to lessen fluid leakage past the plunger.

It can now be understood that the annular liquids that are transferred into production tubing do not have a positive effect on plunger lift efficiency. Additionally, annular liquids are seldom produced at the surface since they experience liquid fall back during the lift cycle. It can also be understood that reducing the volume of annular liquids does not have a detrimental effect on plunger lift efficiency and production volume. Therefore, it is advantageous to reduce the volume of annular liquids as much as practical since it will result in a decrease in the gas contact time with the plunger, reduced or eliminated plunger stalls, higher average plunger velocities, less fluid leakage past the plunger, a higher liquid volume recovered per cycle, more lift cycles per day, and higher production rates from the well It is also important to understand certain wellbore realities. A prudent operator of a well always considers whether a piece of equipment may be fished before it is placed in a wellbore. Fishing is a term used in the oil industry to describe the process of retrieving a piece of equipment from the wellbore that may be stuck in place. The most effective method to free a stuck piece of equipment is to use special tools, namely a wash-over mill and wash pipe, to remove the debris from around the stuck equipment so that it may be retrieved from the wellbore. Physical realities of the dimensions of the wash-over tools and casing, and the equipment's form and material composition dictate the maximum outer diameter that the equipment may have to ensure it may be effectively washed over during fishing operations. If the annular space between a stuck piece of equipment and the casing is too small to allow the wash-over mill and wash pipe to pass, the wash-over mill will be required to mill a portion of the outer diameter of the stuck equipment to remove the debris that is sticking the equipment in place. Therefore, it is important that the composition and form of the outer diameter of the equipment be relatively easy to mill. Metals as hard as carbon steel, or harder, are not easily milled during fishing operations. Additionally, rings, sheaths, sleeves or other devices that surround the tubular joint may spin during the milling operation which can significantly reduce the efficiency of the milling operation and may significantly raise the costs and may even cause a failure to retrieve the equipment from the wellbore. Prudent operators also ensure that equipment placed in a wellbore can maintain material integrity in the hostile environment of a wellbore that may contain corrosive saltwater, CO2 and H2S, temperatures up to 400 degrees Fahrenheit or greater. Additionally, the materials are required to withstand fluctuations in wellbore pressure, temperature, and tubing dimension fluctuations.

One method of reducing the annular fluid volume is to reduce the accommodation space to fluids in the casing annulus. This may be accomplished by installing larger outer diameter tubulars in the wellbore. It is well-known in the oil and gas industry that standard oilfield tubulars are available in numerous outer diameters. Installing a larger diameter standard production tubing string as a method to reduce the annular liquid volume is problematic for several reasons. One reason is that inner diameter of the production tubing string must be consistent through-out the wellbore for efficient plunger lift operations; therefore, the entire production tubing will have to be of the larger outer diameter. Placing a larger diameter tubing string in a well is not practical in terms of cost since the tubulars cost more than smaller diameter tubulars. Additionally, the wellhead may have to be replaced at high costs to accommodate the larger diameter tubing, and placing larger diameter tubing in a well-bore with smaller casing sizes is not conducive for efficient fishing operations.

It is also well-known in the oil and gas and pipeline industries of applying materials externally to a tubular to prevent damage; however, the materials and methods used in manufacturing have several deficiencies for the present disclosure. One deficiency is that the applied materials may be designed for use in non-wellbore applications with materials that cannot withstand the previously mentioned hostile environments of oil and gas wells. Another deficiency is that the applied materials may not be conducive for efficient fishing operations in a wellbore. Still another reason is that the thickness of the applied materials may not be adequate to significantly increase the outer diameter of the tubular. Lastly, the manufacturing costs of applying the material may be not conducive for a low-cost solution for the present disclosure.

As previously stated, plunger lift is a popular lift method usually installed on wells with lower production rates since it has one of the lowest installation and operating costs of the lift methods in the oil and gas industry. Therefore, to meet the economic hurdles of a plunger lift installation, any improvement in plunger lift efficiency will also need to be low-cost. It can now be understood that there is a need for a system and method to reduce the annular fluid volume for plunger lifted wells that is low-cost, is conducive for efficient wash-over fishing operations, can maintain material integrity in hostile wellbore conditions, and provide a consistent internal diameter through-out the production tubular string.

BRIEF SUMMARY OF THE DISCLOSURE

In aspects, the present disclosure is related to a system and method that reduces the annular fluid volume in a wellbore for purposes of improving the lift efficiency of a lift system in an oil or gas well, particularly a plunger lift system.

A system and method are disclosed which decreases the annular fluid volume in the wellbore by increasing the outer diameter of one or more joints in the production tubing string. The most efficient placement of the increased outer diameter joints is from the top of the expected liquid level in the casing to the plunger setting depth.

Examples of the more important features of the disclosure have been summarized rather broadly in order that the detailed description thereof that follows may be better understood and that the contributions they represent to the art may be appreciated. There are, of course, additional features of the disclosure that will be described hereinafter which will form the subject of the claims appended hereto.

BRIEF DESCRIPTION OF THE DRAWINGS

For a detailed understanding of the present disclosure, reference should be made to the following detailed description of the embodiments; taken in conjunction with the accompanying drawings, in which like elements have been given like numerals, wherein.

DETAILED DESCRIPTION OF THE DISCLOSURE

A system and method are proposed for reducing the annular fluid volume of a wellbore to increase the lift efficiency of a lift system, particularly a plunger lift system. In the following descriptions, like parts are numbered similarly and drawings are not drawn to scale throughout the specifications.

Figure 1:
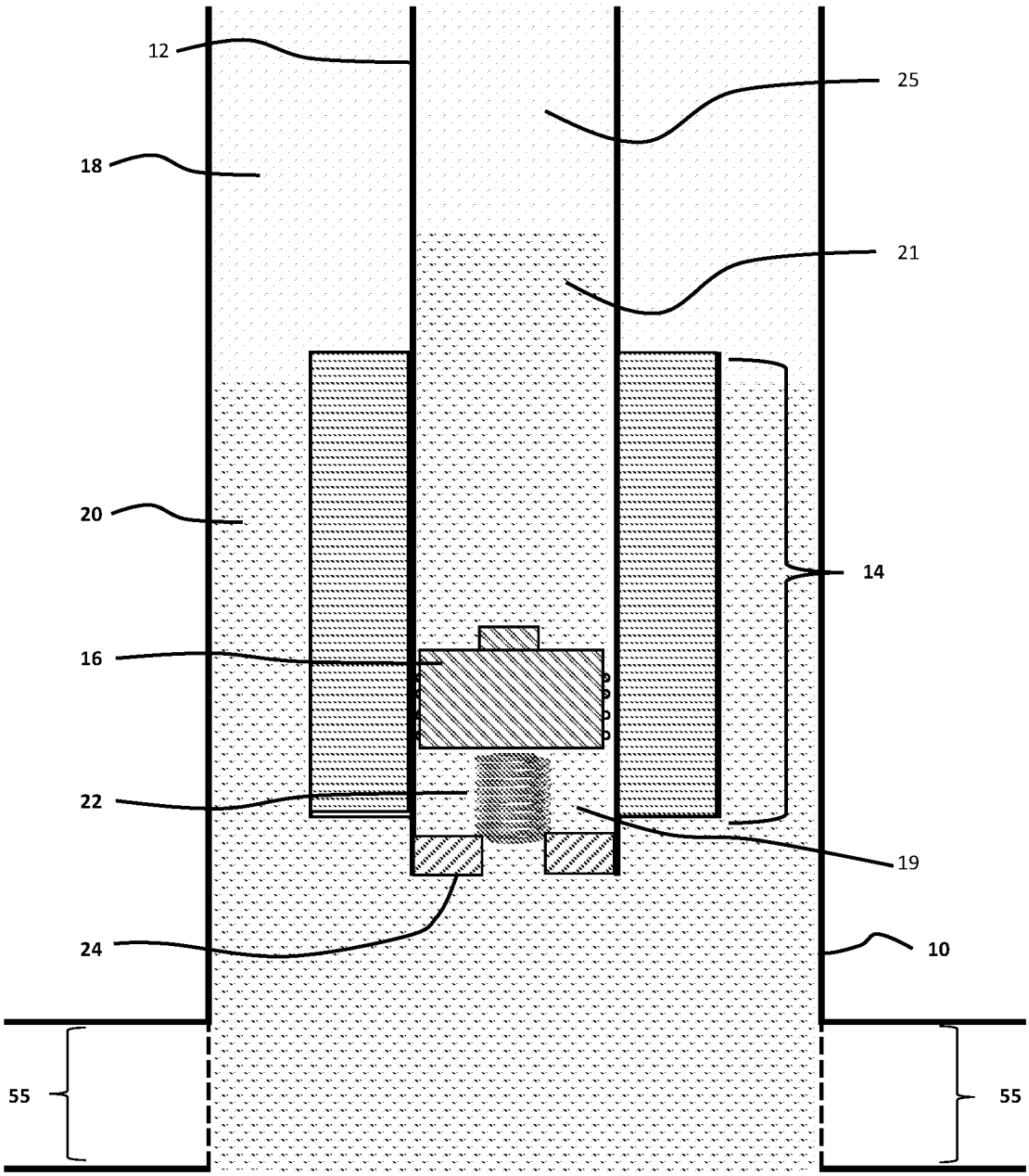
FIG. 1 shows an embodiment of the disclosure with a wellbore containing a plunger lift system installed in the production tubing that includes tubing joints with an increased outer diameter.

FIG. 1 shows one embodiment of a plunger lift system in which the production tubing string contains a section with a larger outer diameter in a vertical wellbore. The disclosure is also contemplated for installations in deviated and horizontal wellbores. Illustrated is a wellbore with a reservoir 55, a casing 10. Inside casing 10 are liquids 20, gas 18, and production tubing string 12 and tubular string 14 containing bumper spring 22 and tubing stop assembly 24, a plunger 16, liquids 19 below plunger 16, liquids 21 above plunger 16, and gas 25. The novelty of this embodiment is tubular string 14, which has an increased outer diameter than production tubing string 12. Tubular string 14 effectively reduces the accommodation space in the annulus of casing 10 that would have been filled with liquids 20.

In operation, the production tubing string 12 and tubular string 14 are installed in casing 10 with a bumper spring 22 and tubing stop 24 connected to the bottom of tubular string 14. The plunger 16 is dropped from the surface into production tubing string 12 and comes to rest on bumper spring 22. The lifting process is as follows; surface valves (not shown) connecting the annulus of casing 10 and the production tubing string 12 to a flowline (not shown) are closed for flow to allow the reservoir 55 to build pressure in the wellbore. Gas 18 and liquids 20 rise in the casing 10 and gas 25 and liquids 19 and 21 rise in tubular string 14 and production tubing string 12 and then separate, forming a gas column on top of a liquid column in the casing 10 annulus and tubular string 14 and production tubing string 12. Once a certain time or surface pressure has been reached, the surface valve connecting the production tubing string 12 to the flowline opens which creates a pressure differential above and below plunger 16. When a sufficient pressure differential is reached, the plunger 16 will begin to rise off the bumper spring 22. The liquids 20 in the annulus of casing 10 become liquids 19 by flowing into production tubing string 12 and tubular string 14 under plunger 16. The annular gas 18 expands and displaces substantially all of liquids 20 into production tubing string 12 and tubular string 14. Gas 18 may then enter and rise in production tubing string 12 and tubular string 14 and Gas 18 eventually rises through the increased column of liquids 19 to contact and lift plunger 16 and liquids 21 to the surface.

As can be now understood, a lower volume of liquids 20 in the annulus of casing 10 results in a lower column height of liquids 19 in production tubing string 12 and tubular string 14 below plunger 16. The lower column height of liquid 19 exerts less hydrostatic pressure which allows gas 18 to flow faster into tubular string 14 and production tubing string 12 to contact plunger 16 in less time. Additionally, plunger 16 will have fewer stalls and a higher average velocity resulting in a higher efficiency lift with more liquids 21 recovered at the surface due to less liquid slippage past plunger 16 resulting in more lift cycles per day and higher production of liquids 21 and gas 18.

Tubular string 14 is shown in FIG. 1 as one continuous string of increased outer diameter tubing. It is contemplated that the tubular string 14 may not be continuous as shown but may be interspersed with non-increased outer diameter tubulars.

Figure 2:
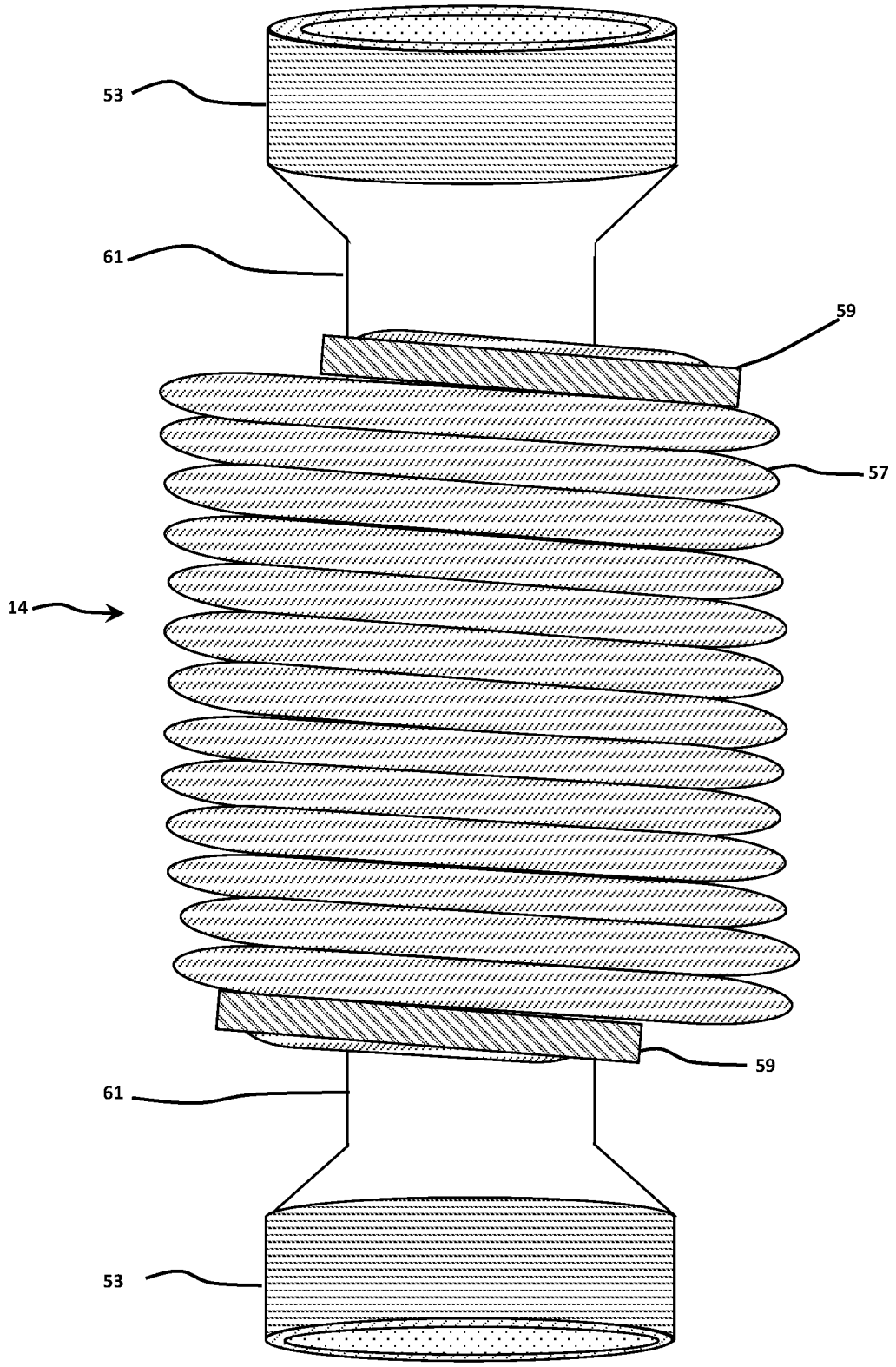
FIG. 2 is a diagram of a preferred embodiment of the disclosure showing a tubing joint wrapped with a rope to achieve an increased outer diameter.

FIG. 2 is a drawing of the preferred embodiment of the present disclosure showing a tubular 14 with threads 53 on both ends and an increased outer diameter created by wrapping a rope 57 around the tube 61 portion of tubular 14. Rope 57 is shown with clamps 59 on both ends to secure rope 57 to tube 61. The rope 57 shown is round in shape but could also have a square shape or other shapes. Numerous joints of tubular 14 may be placed in the wellbore to achieve the desired liquid volume reduction. In the preferred embodiment, a sufficient portion of the upper and lower end of tube 61 is not surrounded by rope 57 to allow space to place the necessary equipment around tube 61 to lift and install tubular 14 in the wellbore. However, it is contemplated that a material may be applied to that space once the tubular 14 has been connected in the production tubing string or that a material may be applied to withstand the forces necessary to lift, connect and install tubular 14 in the wellbore.

In operation, the preferred method of securing rope 57 to tube 61 is by tightly winding rope 57 around tube 61 and then applying clamps 59 around rope 57 and tube 61 at both ends to preserve the friction of rope 57 to tube 61 to prevent rope 57 from unwinding. Additional clamps 59 may be applied at other locations on tube 61 and the individual strands of rope 57 may be stitched together to preserve the applied friction of rope 57 to tube 61. Also, an adhesive may be applied to tube 61 and between the strands of rope 57 to secure rope 57 to tube 61. Tubular 14 is installed into the wellbore in a similar fashion as standard production tubing. In the preferred embodiment, rope 57 is made of ceramic or fiberglass fibers; however, it is contemplated that rope 57 may consist of different materials and may be secured to tube 61 with a different method without departing from the scope of the disclosure. Ceramic or fiberglass fibers were selected since the materials can withstand temperatures up to 1000 degrees Fahrenheit, a PH range between 2 and 12, and are very durable and flexible to withstand the fluctuations in temperatures, pressures, and tubular dimension fluctuations. Since these materials are in the form of a rope, they can also be easily milled should tubular 14 become stuck in place since the individual fibers are of a small diameter. Additionally, rope 57 will be wound around the tube portion 61 in a direction that will tend to keep rope 57 wound tightly as the wash-over mill rotates around tube 61. It is contemplated that rope 57 may be applied to tube 61 in a different method than winding.

Figure 3:
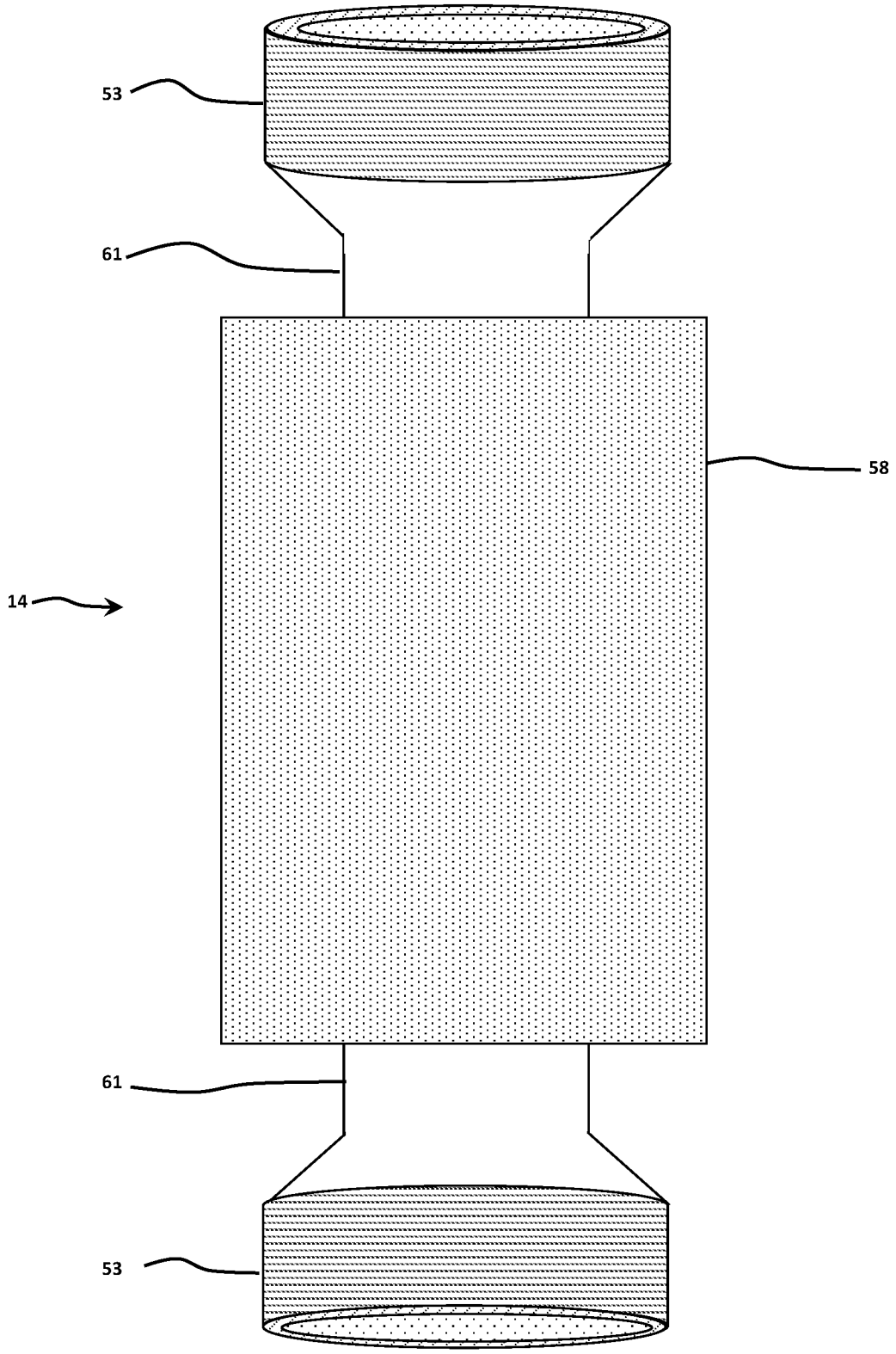
FIG. 3 is a diagram of another embodiment of the disclosure showing a tubing joint covered by a jacket, blanket, or thick coating to achieve an increased outer diameter.

FIG. 3 is a drawing like FIG. 2 except that rope 57 and clamps 59 have been replaced by another embodiment of the present disclosure shown with a covering 58 that is secured around tube 61.

In operation for FIG. 3, it is contemplated that covering 58 may comprise cement or a high temperature thermoplastic or some other substance that cures or sets up around tube 61 to achieve the desired increase in outer diameter. Additionally, the material may be manufactured and then applied around tubular 14 by sliding the material around tube 61 and then securing the material to tube 61. It is also contemplated that an additional covering of a different material may surround covering 58 to protect covering 58 from damage, help secure covering 58 to tube 61, and prevent covering 58 from separating from tubing 61 and becoming mobile in the wellbore.

It can now be understood that the present disclosure reduces the volume of annular liquids by reducing the accommodation space in the casing annulus for purposes of increasing the lift efficiency of a plunger lift system. Since plunger lift is a popular lift method mainly because of the relatively low cost of installation and operation versus other forms of artificial lift, it is important that the present disclosure also be a low-cost solution. A low-cost system and method become even more imperative since some wells may require several hundred feet of increased outer diameter tubing to significantly increase the plunger lift efficiency. Therefore, the system, materials, and method presented herein utilizes the largest outer diameter equipment as practical to maximize the reduction of annular liquids while providing equipment with relatively low costs of materials and manufacturing to accommodate installation in wells with typical plunger lift production rates. Additionally, materials are provided that are relatively easy to mill in wash-over fishing operations without the ability to spin while milling. Lastly, the material can maintain structural integrity under hostile well conditions and the internal diameters of the equipment are the same of the remainder of the production tubing string.

It is also contemplated that the present disclosure is applicable for all forms of plunger lift including, but not limited to, the various types of plungers and number of plungers. It is also contemplated that the present disclosure may be applicable for other lift methods. There are also many different possible wellbore schematics involving additional equipment and configurations that do not reduce the novelty of the disclosure, and even though a plunger lift system is shown, it is contemplated that the system and method of the present disclosure may be applicable to other forms of lift.

While the disclosure has been described regarding exemplary embodiments, it will be understood that various changes, whether stated or not stated herein, may be made and equivalents may be substituted for elements thereof without departing from the scope of the disclosure. In addition, many modifications will be appreciated to adapt a particular instrument, situation, or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

What is claimed is:

1. A system to reduce the annular fluid volume in a wellbore extending from a surface to a subterranean reservoir containing reservoir fluids, the system comprising: a casing disposed in the wellbore; a tubing string disposed in the casing; a lift system disposed in the wellbore; wherein said tubing string contains one or more joints(s) that are surrounded by at least one material that has a differing composition than the composition of said joint(s); and wherein at least a portion of said joint(s) are submerged in the standing liquid level that exists in said casing; and wherein said material increases the outer diameter of the tube portion of said joint(s) by at least 10%.

2. The system of claim 1, wherein said lift system is a plunger lift system.

3. The system of claim 1, wherein said material comprises at least one of: glass, ceramic, natural fibers, synthetic fibers, aramid fibers, metal, silicone, rubber, stone, plastic, carbon, epoxy, cement, polymeric, phenolic, mineral, phenolic, polymeric, resin, sand, a composite.

4. The system of claim 3, wherein said material is in the form of at least one of a: rope, sheet, jacket, wrap, band, tape, sleeve, blanket, strand, coating.

5. The system of claim 4, wherein said material is secured to said tubing string by at least one of: a wrap, tension, an adhesive or adhesion, fastener, tape, tie, friction, band, clamp, stitch.

6. The system of claim 5, wherein said material(s) surrounding said joint(s) can be removed from said joint by a wash-over fishing operation in less time than if said material is of the same composition and form of the material of said tubing string.

7. A method of increasing the lift efficiency of an artificial lift system in a wellbore by reducing the annular fluid volume of a wellbore, comprising the steps of: increasing the outer diameter of one or more joints in said tubing string by surrounding said joint(s) with at least one material having a differing composition than the composition of said joint(s); and, securing said material(s) to said joint(s); and, installing said joint(s) in said wellbore; and, immersing at least a portion of said joint(s) into a liquid column in said wellbore.

8. The method of claim 7, wherein the securing step is accomplished by applying at least one of: an adhesive, fastener, tape, tie, tension, friction, band, clamp, stitch.

9. The method of claim 7 wherein the surrounding step is accomplished by wrapping said material(s) around at least a portion of the exterior surface of said joint(s).

10. The method of claim 7 wherein the surrounding step is accomplished by immersing at least a portion of the exterior surface of said joint(s) in said material(s).

11. The method of claim 7 wherein the surrounding step is accomplished by spraying said material(s) around at least a portion of the exterior surface of said joint(s).

* * * * *